US007918057B2

(12) United States Patent
Moller, Jr.

(10) Patent No.: US 7,918,057 B2
(45) **Date of Patent: *Apr. 5, 2011**

(54) MODULAR FLOOR TILE SYSTEM WITH SLIDING LOCK

(76) Inventor: Jorgen J. Moller, Jr., Salt Lake City, UT (US)

( * ) Notice: Subject to any disclaimer, the term of this patent is extended or adjusted under 35 U.S.C. 154(b) by 142 days.

This patent is subject to a terminal disclaimer.

(21) Appl. No.: 12/507,978

(22) Filed: Jul. 23, 2009

(65) Prior Publication Data

US 2009/0282769 A1 Nov. 19, 2009

Related U.S. Application Data

(63) Continuation of application No. 11/143,337, filed on Jun. 2, 2005, now Pat. No. 7,571,572.

(51) Int. Cl.
*E04F 15/00* (2006.01)

(52) U.S. Cl. ..... 52/177; 52/403.1; 52/591.1; 52/592.1; 404/41

(58) Field of Classification Search ..... 52/177, 52/180, 181, 403.1, 386, 589.1, 591.1, 591.3, 52/592.1, 592.2; 403/329, 396, 408.1, DIG. 14; 404/18, 28, 35, 36, 41, 114, 244
See application file for complete search history.

(56) References Cited

U.S. PATENT DOCUMENTS

| | | | |
|---|---|---|---|
| 738,704 | A | 9/1903 | Semmer |
| 1,420,775 | A | 6/1922 | Stanwood |
| 1,625,187 | A | 4/1927 | Birch |
| D93,991 | S | 12/1934 | Moore |
| 3,015,136 | A | 1/1962 | Doe |
| 3,093,870 | A | 6/1963 | Brock |
| 3,196,763 | A | 7/1965 | Rushton |
| 3,279,138 | A | 10/1966 | Dittmar |
| 3,284,819 | A | 11/1966 | Nissen |
| 3,289,375 | A | 12/1966 | Cline |
| 3,319,392 | A | 5/1967 | Fitzgerald |
| 3,452,497 | A | 7/1969 | Warp |
| 3,717,247 | A | 2/1973 | Moore |
| 3,741,411 | A | 6/1973 | Peacock |

(Continued)

FOREIGN PATENT DOCUMENTS

GB 2262437 A 6/1993

OTHER PUBLICATIONS

Athletic Business, advertisement for Flexideck, p. 81; advertisement for Sport Floor, p. 53; advertisement for Basic Coatings Sports, p. 43, Mar. 2001.

(Continued)

*Primary Examiner* — Brian E Glessner
*Assistant Examiner* — Adriana Figueroa
(74) *Attorney, Agent, or Firm* — Holland & Hart

(57) ABSTRACT

The present invention provides floor tiles and modular floors. The floor tiles may include a locking system that allows adjacent tiles to interlock, while also permitting a predetermined amount of lateral sliding relative to one another. The modular tiles may be injection molded, and a minor change in the mold facilitates variation to the amount of lateral slide allowed between interlocked tiles. The floor tiles may also provide three layers of traction, providing more sure footing than previous flooring systems. In addition, the floor tiles may comprise a two-tier suspension system that yields a flex or spring-like effect.

32 Claims, 3 Drawing Sheets

U.S. PATENT DOCUMENTS

| | | | | | |
|---|---|---|---|---|---|
| 3,861,592 | A | | 1/1975 | Fisher | |
| 3,909,996 | A | | 10/1975 | Ettlinger, Jr. et al. | |
| 4,008,548 | A | * | 2/1977 | Leclerc | 52/180 |
| 4,051,987 | A | | 10/1977 | Schribner | |
| 4,133,481 | A | | 1/1979 | Bennett | |
| 4,211,366 | A | | 7/1980 | Czarnota | |
| 4,226,060 | A | | 10/1980 | Sato | |
| 4,287,693 | A | | 9/1981 | Collette | |
| 4,436,779 | A | | 3/1984 | Menconi et al. | |
| 4,543,765 | A | | 10/1985 | Barrett | |
| 4,584,221 | A | * | 4/1986 | Kung | 428/44 |
| 4,715,743 | A | | 12/1987 | Schmanski | |
| 4,826,351 | A | | 5/1989 | Haberhauer et al. | |
| 4,860,510 | A | | 8/1989 | Kotler | |
| 4,917,532 | A | * | 4/1990 | Haberhauer et al. | 404/35 |
| 4,930,286 | A | | 6/1990 | Kotler | |
| 5,014,488 | A | | 5/1991 | Evangelos et al. | |
| 5,033,241 | A | | 7/1991 | Max | |
| 5,275,502 | A | | 1/1994 | Glaza | |
| 5,323,575 | A | | 6/1994 | Yeh | |
| 5,364,204 | A | * | 11/1994 | MacLeod | 404/35 |
| 5,527,128 | A | * | 6/1996 | Rope et al. | 404/35 |
| 5,628,160 | A | * | 5/1997 | Kung | 52/591.1 |
| D383,253 | S | | 9/1997 | Semenuk | |
| D385,974 | S | | 11/1997 | Berger | |
| D385,978 | S | | 11/1997 | Berger | |
| 5,761,867 | A | | 6/1998 | Carling | |
| 5,787,654 | A | | 8/1998 | Drost | |
| 5,807,021 | A | | 9/1998 | Aaron | |
| 5,815,995 | A | | 10/1998 | Adam | |
| 5,833,386 | A | | 11/1998 | Rosan et al. | |
| 5,950,378 | A | * | 9/1999 | Council et al. | 52/177 |
| 5,992,106 | A | | 11/1999 | Carling et al. | |
| 6,061,979 | A | | 5/2000 | Johannes | |
| 6,089,784 | A | | 7/2000 | Ardern | |
| 6,098,354 | A | | 8/2000 | Skandis | |
| D456,533 | S | | 4/2002 | Moller, Jr. | |
| D462,792 | S | | 9/2002 | Katsumasa | |
| 6,467,224 | B1 | | 10/2002 | Bertolini | |
| 6,526,705 | B1 | | 3/2003 | MacDonald | |
| D481,470 | S | | 10/2003 | Moller, Jr. | |
| 6,751,912 | B2 | | 6/2004 | Stegner et al. | |
| 6,802,159 | B1 | | 10/2004 | Kotler | |
| 6,878,430 | B2 | | 4/2005 | Milewski et al. | |
| D516,737 | S | | 3/2006 | Moller, Jr. | |
| 7,331,147 | B2 | | 2/2008 | Kalisiak et al. | |
| 2005/0193669 | A1 | | 9/2005 | Jenkins et al. | |
| 2005/0223666 | A1 | * | 10/2005 | Forster et al. | 52/392 |
| 2006/0265975 | A1 | * | 11/2006 | Geffe | 52/177 |
| 2007/0044412 | A1 | * | 3/2007 | Forster et al. | 52/592.1 |

OTHER PUBLICATIONS

Athletic Business, advertisement for Hid-N-Lok School Color Series tiles; advertisement for Fitness Flooring, p. 29; advertisement for Mitchell Rubber Products, p. 30; advertisement for Loktuff, p. 34; advertisement for Dri-Dek, p. 74, advertisement for Tepromark, p. 77; advertisement forHaro Sports Floors, p. 100; advertisement for Plexipave, p. 127; advertisement for Aacer Flooring, p. 226; advertisement for Spidertile, p. 236; advertisement for Mateflex, p. 259; advertisement for SportCourt, pp. 280-281; Feb. 2004.

Brochure, "It's Not Just a Sports Floor," Sport Court Performance Sports Flooring, date unknown.

A Complete Guide to Sports Surfaces and Flooring, advertisement for Sport Court, p. 5; advertisement for Multi-Play Sports Flooring, p. 9; advertisement for Rubber Products, p. 9; advertisement for SnapCourt Floors, p. 12; advertisement for PlayGuard, p. 15; advertisment for American Sports Builders Association, p. 15; advertisement for "Unity" Surfacing Systems, p. 22; advertisement for Dynamic Sports Constructions, Inc., p. 22; advertisement for Versacourt, p. 23; advertisement for Swiss Flex, p. 26; advertisement for SportMaster Sport Surfaces, p. 26; advertisement for Centaur Floor Systems, p. 30; advertisement for All Deck, p. 30; Jul./Aug. 2005.

Program for AVCA 2003 Annual Convention, advertisement for Mateflex, p. 12, Dec. 2003.

Athletic Business, advertisement for Dri-Dek, p. 47; advertisement for Mateflex, p. 97; advertisement for Duragrid, p. 132; advertisement for Kiefer Specialty Flooring, Inc., p. 134, Dec. 2003.

Athletic Business, advertisement for Mateflex, p. 16; advertisement for Aacer Flooring, p. 41; advertisement for Sport Court, p. 50; advertisement for Dri-Dek, p. 83; advertisements for Horner Flooring Co., Kiefer Specialty Flooring, Inc., and Mateflex-Mele Corp., p. 103; advertisements for Oscoda Plastics, Inc. and Primier Tiles, p. 104; advertisements for Spidercourt, Inc., Sport Court, Inc., Sport Floors, Inc., Sporturf, Sprinturf, Sri Sports, Inc., Superior Floor Company, Inc., and Synthetic Surfaces, p. 106; Nov. 2003.

Athletic Business, advertisements for Dri-Dek and Fitness Flooring, p. 77; advertisements for Dri-Dek/Kendall Products and Duragrid, p. 91; advertisement for Mateflex-Mele Corp., p. 94; advertisements for Dri-Dek/Kendall Products, Dodge-Regupol, Inc., p. 104, Jul. 2002.

Athletic Business, advertisement for Dri-Dek, p. 83; Jul. 2004.

Athletic Business, advertisement for Aacer Flooring, p. 10; advertisement for SnapCourt Sports Floor, p. 14; advertisement for Dri-Dek, p. 65; advertisement for Matexlfex, p. 231; advertisement for Sport Court, p. 241-243; advertisements for ProLine SPF and Swiss Flex, p. 245, Feb. 2005.

Athletic Business, advertisement for Dri-Dek, p. 12; advertisement for Mateflex, p. 91; advertisements for Dri-Dek, Everlast Performance Flooring, p. 112; advertisement for Mateflex, p. 115, Aug. 2005.

Athletic Business, advertisement for Mateflex, p. 51; advertisement for Dri-Dek, p. 63; advertisement for Dri-Dek, p. 96, Aug. 2004.

Recreation Management, advertisements for Taraflex Sports Flooring, Aacer Flooring, LLC, Action Floor Systems, Aeson Flooring Systems, Centaur Floor Systems, LLC; Swiss Flex, Sport Court International, p. 217; advertisements for Mitchell Rubber Products, Fitness Flooring, Summit Flexible Products, Premier Court, p. 218; advertisement for Aacer Flooring, p. 221; advertisements for SportMaster Sport Surfaces and Swiss Flex, p. 227; advertisement for Sport Court, p. 229, Dec. 2004.

Grassroots Motor Sports, advertisement for RaceDeck, p. 61; Article, "Floored—Two Ways to Make Your Shop Floor Look Beautiful," pp. 125-126, Mar. 2002.

Athletic Business, advertisement for Dri-Dek, p. 55; advertisements for Rubber Products and Multi-Play Sports Flooring, p. 139; advertisement for Fitness Flooring, p. 167; advertisement for Mateflex, p. 233; advertisements for Centaur Floor Systems and Flex Court, p. 250; advertisement for Athletic Surface Systems (Sport Court), p. 281-284, Feb. 2006.

Club Management, advertisement for Duragrid, p. 161; Apr. 2002.

Athletic Business, advertisement for Sport Court, p. 39; advertisement for Dri-Dek, p. 49; advertisement for VersaCourt, p. 93, Sep. 2004.

Recreation Management, advertisement for Sport Court, p. 9; advertisement for Dri-Dek, p. 21, May/Jun. 2005.

Athletic Business, advertisement for Dri-Dek, p. 16; advertisement for SpiderTile, p. 20; advertisement for Mateflex, p. 69; advertisements for Premier Tiles, Prestige Enterprises International, Inc., Rhino Sports, and Robbins Sports Surfaces, p. 139; advertisements for SpiderCourt Inc., Sport Court, Inc. and Sports Floors, Inc., p. 141, Apr. 2003.

Institutional Flooring, Competitive information, Sport Court, Jan. 2004.

Advertisement for IceCourt XS, date unknown.

Brochure for Mateflex, 8 pages, date unknown.

* cited by examiner

MODULAR FLOOR TILE SYSTEM WITH SLIDING LOCK

RELATED APPLICATION

This is a continuation of U.S. patent application Ser. No. 11/143,337 filed on 2 Jun. 2005, now pending, the disclosure of which is incorporated, in its entirety, by this reference.

TECHNICAL FIELD

This invention relates generally to floor tiles, and more particularly to modular floor systems.

BACKGROUND OF THE INVENTION

Floor tiles have traditionally been used for many different purposes, including both aesthetic and utilitarian purposes. For example, floor tiles of a particular color may be used to accentuate an object displayed on top of the tiles. Alternatively, floor tiles may be used to simply protect the surface beneath the tiles from various forms of damage. Floor tiles typically comprise individual panels that are placed on the ground either permanently or temporarily depending on the application. A permanent application may involve adhering the tiles to the floor in some way, whereas a temporary application would simply involve setting the tiles on the floor. Some floor tiles can be interconnected to one another to cover large floor areas such as a garage, an office, or a show floor.

Various interconnection systems have been utilized to connect floor tiles horizontally with one another to maintain structural integrity and provide a desirable, unified appearance. In addition, floor tiles can be manufactured in many shapes, colors, and patterns. Some floor tiles contain open holes allowing fluid and small debris to pass through the floor tiles and onto a surface below. Tiles can also be equipped with special surface patterns or structures to provide various superficial or useful characteristics. For example, a diamond steel pattern may be used to provide increased surface traction on the tiles and to provide a desirable aesthetic appearance. Nevertheless, traction on current modular tiles is less than ideal.

Some interconnected tile systems are used as dance floors and sports court surfaces. Current interconnected tile systems used for sports and dancing are rigidly connected. The rigid connections do not allow movement between the tiles and do not absorb any significant impact energy as the dancers and sports participants use the floors. Most of the impact forces resulting from running and jumping on the current floors is absorbed by the participant. Over time, the impacts associated with dancing and other sports events conducted on a rigid floor can lead to general discomfort or injuries. Therefore, there is a need for a modular flooring system that facilitates some movement between the tiles. The present invention is directed to overcoming, or at least reducing the effect of, one or more of the problems presented above.

SUMMARY OF EMBODIMENTS OF THE INVENTION

In one of many possible embodiments, the present invention provides a modular floor tile. The modular floor tile comprises a first open surface, a plurality of edge surfaces, a plurality of loops disposed in at least one of the plurality of edge surfaces, and a plurality of locking tab assemblies disposed in at least one of the plurality of edge surfaces. Each of the plurality of locking tabs assemblies may comprise a center post and flanking hooks. Each of the plurality of loops may include first and second lips protruding from first and second sides, respectively, of the loops. The plurality of loops may be receptive of a plurality of the center posts and the flanking hooks of an adjacent tile, where the flanking hooks snap fit over the lips of the locking loops. The plurality of loops and the center posts of the plurality of locking tab assemblies are sized with a lateral sliding clearance of at least 0.0625 inches, preferably at least about 0.100 inches. The plurality of locking tab assemblies may comprise double locks, wherein each locking tab assembly remains slidingly locked if one of the flanking hooks breaks.

According some embodiments of the invention, the modular floor tiles comprise a plurality of support legs extending from the first open surface. The plurality of support legs may include a first set of support legs having a first length, and a second set of support legs having a second length, the second length being shorter than the first length. The first and second sets of support legs may be arranged in an alternating pattern comprising a first leg of the first length, and a group of four legs of the second length.

Some embodiments of the modular floor tile of the present invention comprise at least three traction layers in the first open surface.

Some embodiments of the modular floor tile of the present invention comprise a plurality of biasing members disposed in at least one of the edge surfaces for maintaining spacing with an adjacent tile. The biasing members may comprise a plurality of cantilevered spring fingers extending at an angle from two of the edge surfaces. The spring fingers maintain a regular spacing between adjacent, interlocked, modular tiles.

One embodiment of the present invention provides a floor apparatus comprising a modular floor. The modular floor comprises at least two injection molded modular tiles locked together and laterally movable therebetween. A spring load between the at least two injection molded modular tiles may bias the tiles to a predetermined spacing. Each of the at least two injection molded modular tiles may comprises an open support surface, the open support surface comprising at least three layers of traction. Each of the at least two injection molded modular tiles may also comprise a multiple-tier suspension system. The at least two injection molded modular tiles may comprise a plurality of tiles having, in combination, a series of lines corresponding to regulation lines of a sports court.

Another embodiment of the present invention provides a flooring apparatus comprising a modular tile, the modular tile comprising a top surface having open holes and at least three traction layers at different elevations, and a multiple-tier suspension system. The multiple-tier suspension system may comprise a plurality of support legs. The plurality of support legs may comprise a first set of support legs having a first length, and a second set of support legs having a second length, the second length being shorter than the first length. The modular tile may comprise a locking system for attachment to similar or identical modular tiles, the locking system allowing lateral displacement between the modular tile and adjacent modular tiles while interlocked.

One aspect of the invention relates to a method of making modular floor tiles. The method comprises providing a mold, injecting liquid polymer into the mold, shaping the liquid polymer with the mold to provide a top surface and an interlocking system, and solidifying the liquid polymer. The interlocking system locks multiple tiles together while simultaneously allowing a predetermined amount of lateral sliding between adjacent tiles. Shaping may comprise creating a plurality of loops disposed in at least one side edge, the loops having a protruding rim, and creating a plurality of locking tab assemblies disposed in at least one other side edge, each of the plurality of locking tabs assemblies comprising a center post and flanking hooks. The method may further comprise varying a depth of the center posts in the mold to adjust the predetermined amount of lateral sliding allowed between adjacent tiles.

The foregoing features and advantages, together with other features and advantages of the present invention, will become more apparent when referring to the following specifications claims and accompanying drawings.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION OF THE INVENTION

As mentioned above, typical modular flooring comprises rigidly connected individual tiles. The comfort to users of typical modular flooring is often significantly compromised by the rigidity of the tiles. The typical modular floor offers littler or no resilience to dance, sport, pedestrian, and other traffic. The present invention describes methods and apparatus that provide better traction and more flexibility than previous flooring systems. However, the application of the principles described herein is not limited to the specific embodiments shown. The principles described herein may be used with any flooring system. Moreover, although certain embodiments shown incorporate multiple novel features, the features may be independent and need not all be used together in a single embodiment. Tiles and flooring systems according to principles of the present invention may comprise any number of the features presented. Therefore, while the description below is directed primarily to interlocking plastic modular floors, the methods and apparatus are only limited by the appended claims.

As used throughout the claims and specification, the term "modular" refers to objects of regular or standardized units or dimensions, as to provide multiple components for assembly of flexible arrangements and uses. The words "including" and "having," as used in the specification, including the claims, have the same meaning as the word "comprising."

Figure 1:
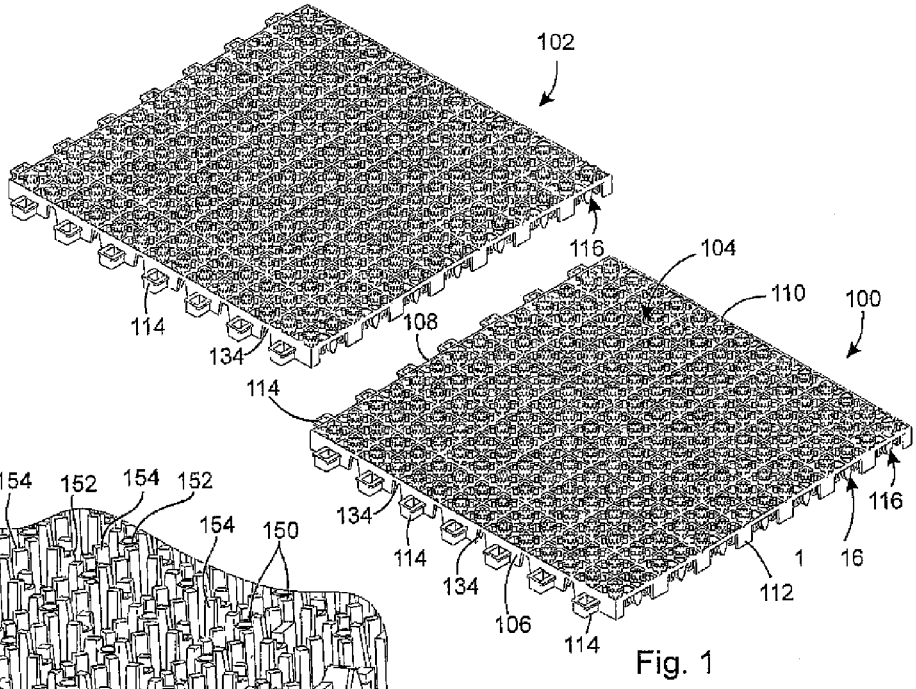
FIG. 1 is a perspective assembly view of two modular floor tiles according to one embodiment of the present invention.

Referring now to the drawings, FIG. 1 illustrates in assembly view a set of two modular tiles 100, 102 according to principles of the present invention. The modular floor tiles 100, 102 of FIG. 1 may comprise injection molded plastic. The two modular tiles 100, 102 and other similar or identical tiles may be interlocked according to principles of the present invention to form a floor, such as a sports court floor discussed below with reference to FIG. 7. However, unlike conventional modular flooring systems, the modular tiles 100, 102 facilitate lateral sliding movement between adjacent tiles.

Each of the modular tiles 100, 102 comprises a first or top open surface 104. The term "open" indicates that the top open surface 104 includes open holes or spaces through which fluid may drain. The modular tiles 100, 102 of FIG. 1 may be rectangular or square as shown, although other shapes may also be used. The modular tiles 100, 102 also include a plurality of side edges, which, according to the embodiment of FIG. 1, include four side edges 106, 108, 110, 112. As least one of the side edges of each modular tile 100, 102 includes a plurality of loops 114. However, according to the embodiment of FIG. 1, a plurality of loops is disposed in each of the first and second adjacent side surfaces 106, 108. The loops 114 are preferably spaced along the first and second side surfaces 106, 108 at substantially equal intervals.

Each of the plurality of loops 114 is receptive of a mating locking tab assembly 116 from an adjacent modular tile. According to the embodiment of FIG. 1, each of the third and fourth adjacent side surfaces 110, 112 includes a plurality of locking tab assemblies 116. The modular tiles 100, 102 may include an equal number of locking tab assemblies 116 and loops 114. Moreover, the locking tab assemblies 116 may be spaced at the same intervals as the loops 114.

The loops 114 of the first modular tile 100 are receptive of the locking tab assemblies 116 of an adjacent modular tile such as the second tile 102. Thus, the first and second modular tiles 100, 102 may be interlocked or connected together as shown in FIGS. 2A-2B and 3A-3B. FIGS. 2A-2B and 3A-3B illustrate the interconnected first and second modular tiles 100, 102 according to a top and a perspective view, respectively.

Figure 3A:
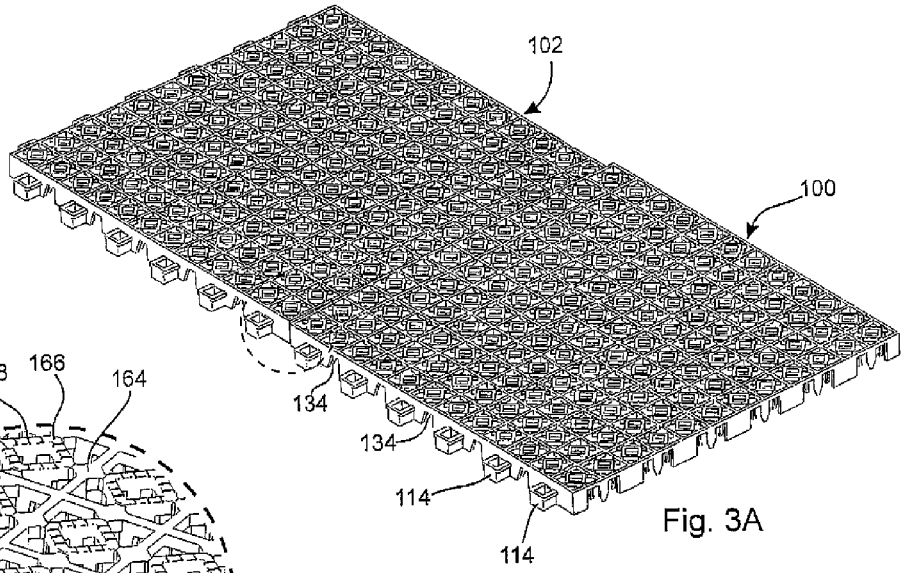
FIG. 3A is a perspective assembled view the modular floor tiles of FIG. 2A.
Figure 3B:
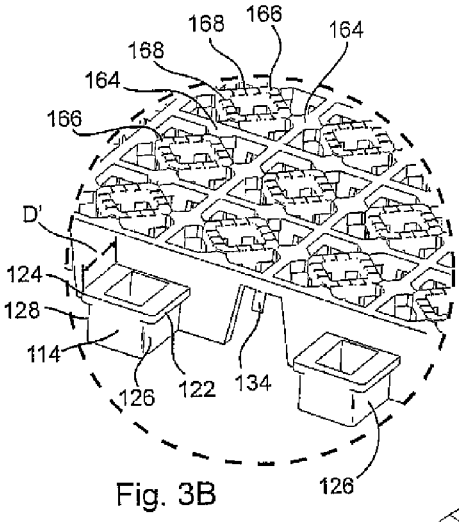
FIG. 3B is a magnified inset of a portion of the illustration shown in FIG. 3A.
Figure 4:
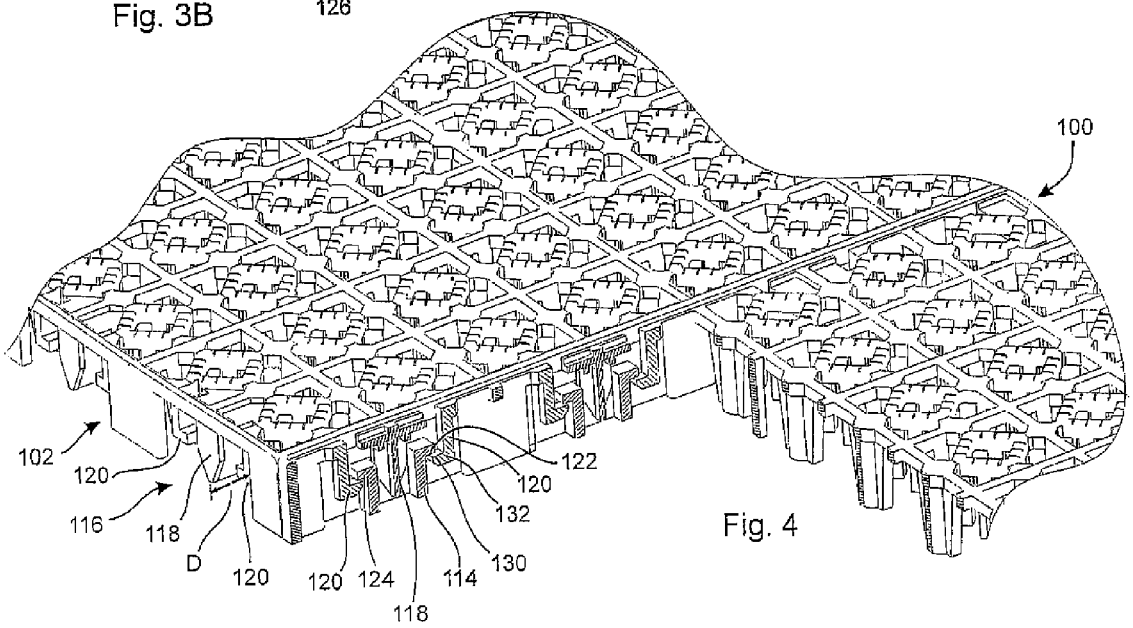
FIG. 4 is a magnified partial cross-sectional view of the modular floor tiles of FIG. 3A.

FIG. 4 best illustrates the details of the interconnection between adjacent modular tiles 100, 102. Each of the locking tab assemblies 116 may comprise a center post 118 of depth D and flanking hooks 120. The flanking hooks 120 may be cantilevered. One flanking hook 120 is opposed another flanking hook 120. In addition, as best shown in FIG. 3B, each of the loops 114 comprises a rim or lip, which may include first and second lips 122, 124 protruding from first and second sides 126, 128, respectively, of the loops 114. As the adjacent modular tiles 100, 102 are locked together as shown in FIG. 4, the center post 118 is inserted into the associated loop 114, and the flanking hooks 120 flex around and snap-fit over the associated lips 122, 124. Once snapped over the lips 122, 124, the flanking hooks 120 resist disconnection of the adjacent modular tiles 100, 102. However, the length of the flanking hooks 120 provides a vertical clearance 130 between the lips 122, 124 and prongs 132 of the flanking hooks 120. The vertical clearance 130 allows adjacent, interlocked modular tiles 100, 102 to displace vertically a predetermined distance with respect to one another, even while remaining interlocked. According to some embodiments, the vertical clearance 130 (and thus the vertical displacement) comprises at least about 0.0625 inches, and may be at least about 0.125 inches or more. Moreover, the flanking hooks 120 comprise double locks and operate independent of one another. Therefore, even if one of the flanking hooks 120 breaks or is otherwise incapacitated, the lock between the locking tab assembly 116 and the loop 114 remains intact.

In addition, although the prongs 132 of the flanking hooks 120 provide a double lock against disconnection of the adjacent modular tiles 100, 102, they permit sliding lateral displacement between the adjacent modular tiles 100, 102. A predetermined amount of sliding lateral displacement between the adjacent modular tiles 100, 102 may be controlled, for example, by the depth D of the center post 118, in combination with the depth D' (FIG. 3B) of the loop 114. A predetermined clearance between the depth D of the center post 118 and the depth D' (FIG. 3B) of the loop 114 may fix the maximum lateral displacement between the adjacent modular tiles 100, 102. According to some embodiments, the predetermined lateral displacement may be at least 0.0625 inches, and is preferably at least about 0.100-0.125 inches. Thus, the interconnection between adjacent modular tiles 100, 102 according to principles of the present invention advantageously permits some relative displacement both vertically and laterally, and provides a more comfortable feel to users, especially at quick stops and starts.

Figure 5:
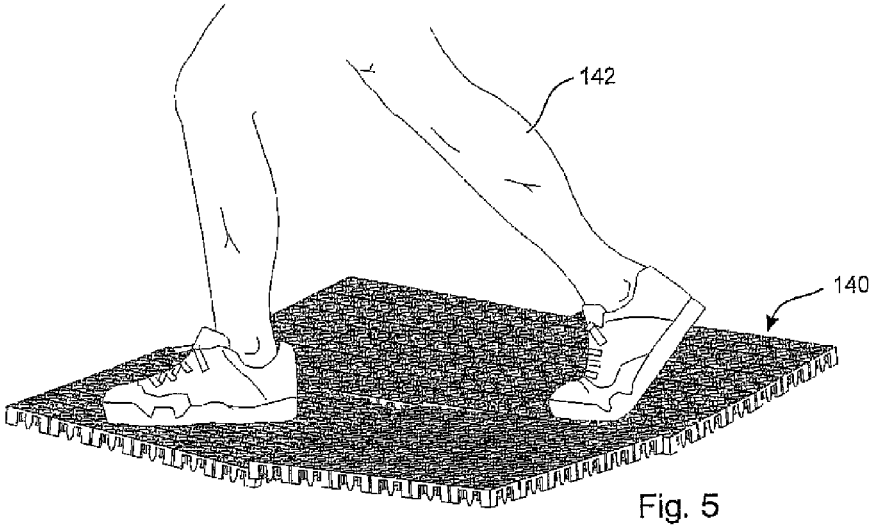
FIG. 5 is a magnified perspective view of a user stepping on a modular floor according to one embodiment of the present invention.

However, although the principles described herein facilitate lateral displacement between interlocked modular tiles, a complete floor may tend to look sloppy and misaligned in some configurations. Therefore, according to some embodiments of the present invention, adjacent modular tiles may be biased or spring loaded to a specific, generally equal spacing therebetween. Referring to FIGS. 1 and 3A-3B, one or more of the side walls 106-112 may include one or more biasing members such as spring fingers 134 disposed therein. According to the embodiment of FIGS. 3A-3B, the spring fingers 134 comprise three cantilevered, angled spring fingers spaced between alternating loops 114 and disposed in both of the first and second side walls 106, 108. Nevertheless, the spring fingers 134 may just as effectively be placed in the third and fourth side walls 110, 112, or even in all four side walls. The spring fingers 134 thus tend to bear against adjacent side walls of adjacent tiles, aligning all of the modular floor tiles in a floor to a substantially equal spacing, while also permitting lateral displacement upon the application of a sufficient lateral force. FIG. 5 illustrates an (exaggerated) displacement of adjacent modular tiles of a floor 140 as a player 142 lands forcefully. Much of the impact energy may be absorbed by the floor 140, instead of by the player 142, according to principles of the present invention.

Figure 6:
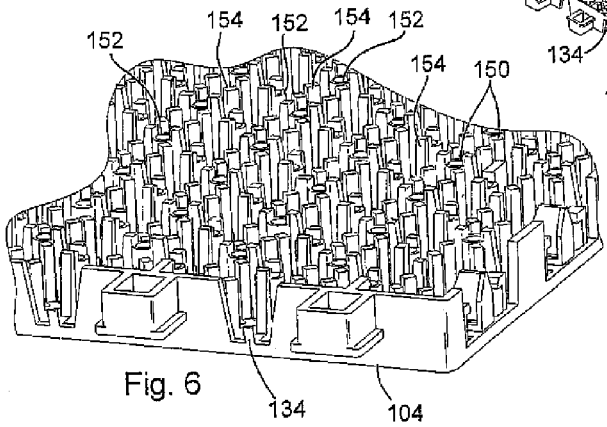
FIG. 6 is a bottom perspective view of the modular floor tiles of FIG. 1.
Figure 2B:
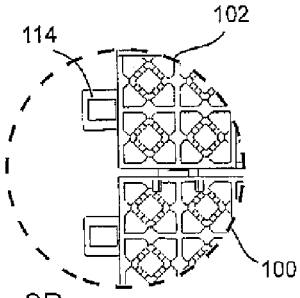
FIG. 2B is a magnified inset of a portion of the two modular floor tiles of FIG. 2A.
Figure 2A:
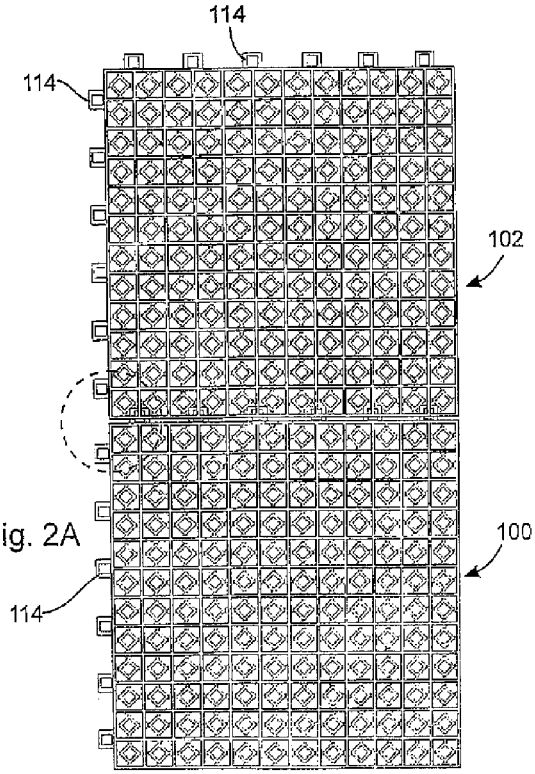
FIG. 2A is a top assembled view of the two modular floor tiles of FIG. 1.

Each of the modular tiles 100, 102 includes a support system under the top open surface 104. According to some aspects of the present invention, the support system comprises a multiple-tier suspension system. One embodiment of the multiple-tier suspension system is illustrated in FIG. 6, and comprises a two-tier suspension system 150. The two-tier suspension system 150 comprises a plurality of support legs extending down from the first open surface 104. The plurality of support legs may comprise a first set of primary support legs 152 having a first length, and a second set of support legs 154 having a second length. The second length of the second set of support legs 154 is shorter than the first length of the first set of support legs 152. Therefore, absent a load, only the first set of support legs 154 contacts the ground. The first and second sets of support legs 152, 154 may be arranged in an alternating pattern as shown in FIG. 6. The pattern may comprise alternating rows or columns of first and second sets of support legs 152, 154. In addition, the first set of support legs 152 may comprise a split or fork legs as shown, and the second set of support legs 154 may comprise clusters of three or four legs. The spacing of the first set of support legs 152 facilitates vertical flexing or springing of each of the modular tiles 100. That is to say, as a load is applied to one or more of the modular tiles 100, 102 on the first open surface 104, the first open surface 104 "gives" or tends to flex, until the second set of support legs 154 contacts the ground. Accordingly, application of the principles of the present invention may result in a comfortable spring-like modular floor.

Figure 7:
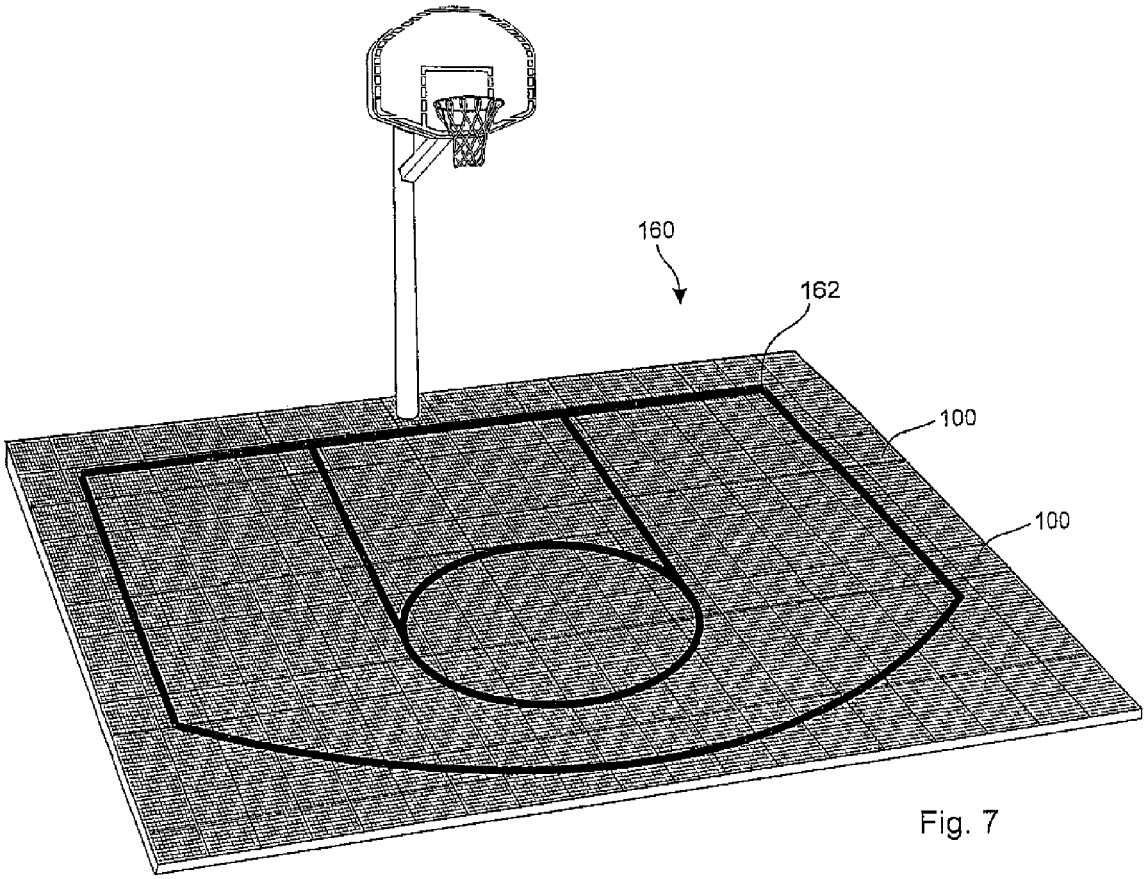
FIG. 7 is a perspective view of a modular floor arranged as a sports court according to one embodiment of the present invention.

The modular tiles 100, 102 described above, along with a plurality of additional similar or identical modular tiles, may be arranged in any configuration to create a floor. For example, as shown in FIG. 7, a plurality of modular tiles 100 may be arranged to form a sports court floor 160. The sports court floor 160 may include lines corresponding to regulation sports floor lines, such as the basketball court lines 162 shown in FIG. 7. The lines may be painted onto or otherwise formed in the modular tiles 100.

For many uses of the modular tiles 100, including the sports court floor 160, traction can be important. Therefore, according to some embodiments of the present invention, the modular tiles 100 include multiple traction layers. For example, as shown in FIG. 3B, the modular tiles 100, 102 comprise three traction layers. A first of the three traction layers may comprise a first webbing 164 that runs in lines generally parallel and perpendicular to edges of the modular tiles 100, 102. The first webbing 164 is at a first elevation that may be, for example, at about 0.6875 inches from a ground surface (the height of the side walls 106-112 (FIG. 1) may be about 0.75 inches). A second of the traction layers may comprise a general diamond pattern surface 166 disposed in between perpendicular lines of the first webbing 164. The diamond pattern surface 166 may be substantially flush with the side wall height at about 0.75 inches. A third traction layer may comprise a plurality of ridges 168 protruding from the diamond pattern surface 166. The plurality of ridges 168 may comprise three ridges in each side of the diamond pattern. The plurality of ridges 168 may be elevated slightly from the diamond pattern surface 166 a distance of about 0.05-0.125 inches. The three traction layers 164, 166, 168 provide exceptional traction and reduce the risk of slipping and other hazards.

According to some aspects of the invention, the modular floor tiles 100, 102 may be made by providing a mold, injecting liquid polymer into the mold, shaping the liquid polymer with the mold to provide a top surface 104 and an interlocking system 114, 116, and solidifying the liquid polymer. The shaping of the modular tiles 100, 102 may comprise creating the plurality of loops 114 disposed in at least one side edge 106, the loops 114 having a protruding rim 122, and creating a plurality of locking tab assemblies 116 disposed in at least one other side edge 108, each of the plurality of locking tabs assemblies 116 comprising a center post 118 and flanking hooks 120. The method may further comprise varying a depth D of the center posts in the mold to adjust the predetermined amount of lateral sliding allowed between adjacent tiles.

The preceding description has been presented only to illustrate and describe exemplary embodiments of invention. It is not intended to be exhaustive or to limit the invention to any precise form disclosed. Many modifications and variations are possible in light of the above teaching. It is intended that the scope of the invention be defined by the following claims.

The invention claimed is:

1. A modular floor tile, comprising:

a first open surface;

a plurality of edge surfaces;

a plurality of protrusions extending outwardly from at least one of the plurality of edge surfaces;

a plurality of locking tab assemblies each comprising a pair of flanking hooks arranged opposite each other and each having at least one prong that faces the at least one prong of the opposite flanking hook;

wherein the flanking hooks of one tile snap fit over a lip of the protrusions of an adjacent tile, and a portion of at least one of the locking tab assemblies extends through one of the protrusions.

2. A modular floor tile according to claim 1, wherein the lip of each protrusion is defined in part by a surface of the protrusion that faces opposite of the first open surface.

3. A modular floor tile according to claim 1, wherein the plurality of protrusions and the flanking hooks are sized to permit lateral sliding of the locking tab assemblies relative to the protrusions.

4. A modular floor tile according to claim 1, further comprising a plurality of support legs extending from the first open surface.

5. A modular floor tile according to claim 1, wherein the first open surface comprises at least two traction layers.

6. A modular floor tile according to claim 1, further comprising a plurality of biasing members disposed in at least one of the edge surfaces for maintaining spacing with an adjacent tile.

7. A modular floor tile according to claim 1, further comprising a plurality of biasing members extending from at least one of the edge surfaces, the biasing members being arranged to contact an adjacent tile for maintaining spacing with the adjacent tile.

8. A modular floor tile according to claim 1, wherein the locking tab assemblies are disposed in at least one of the plurality of edge surfaces.

9. A modular floor tile, comprising:

a first open surface;

a plurality of edge surfaces;

a plurality of protrusions extending outwardly from at least one of the plurality of edge surfaces, at least some of the protrusions having at least one pass through opening;

a plurality of pairs of flanking hooks arranged opposite each other and each having at least one prong that faces the at least one prong of the opposite flanking hook, the flanking hooks being configured to snap fit over an edge of the protrusions of an adjacent tile.

10. A modular floor tile according to claim 9, wherein the edge of each protrusion is defined by the intersection of a side facing surface of the protrusion and a surface of the protrusion that faces opposite the first open surface.

11. A modular floor tile according to claim 9, wherein the protrusions have a rectangular shape as viewed from above the first open surface.

12. A modular floor tile according to claim 9, wherein each pair of the opposed flanking hooks are spaced apart a distance at least as great as a width dimension of one of the protrusions.

13. A modular floor tile according to claim 9, wherein the flanking hooks are spaced inward from the edge surfaces.

14. A floor apparatus, comprising:

a modular floor, comprising:

at least two injection molded modular tiles locked together and laterally movable toward and away from each other, each modular tile comprising:

an open top surface;

a plurality of edge surfaces;

a plurality of protrusions extending outwardly from at least one of the plurality of edge surfaces, at least some of the protrusions having at least one pass through opening;

a plurality of locking tab assemblies comprising a pair of flanking hooks arranged opposite each other and each having at least one prong that faces the at least one prong of the opposite flanking hook, the flanking hooks being configured to snap fit over the protrusions, and a portion of at least some of the locking tab assemblies extending through the at least one pass through opening of the protrusion.

15. A floor apparatus according to claim 14, further comprising a spring member positioned between the at least two injection molded modular tiles that biases the tiles to a predetermined spacing.

16. A floor apparatus according to claim 14, wherein each of the at least two injection molded modular tiles comprises a plurality of support legs extending opposite from the open top surface.

17. A floor apparatus according to claim 16, wherein the opposed flanking hooks have a length that is less than a length of the support legs.

18. A floor apparatus according to claim 14, wherein the protrusions comprise a hollow interior.

19. A modular floor tile, comprising:

a first open surface;

a plurality of edge surfaces;

a plurality of protrusions extending outwardly from at least one of the plurality of edge surfaces;

a plurality of locking tab assemblies comprising opposed flanking hooks;

wherein the flanking hooks of one tile snap fit over a lip of the protrusions of an adjacent tile, and a portion of at least one of the locking tab assemblies extends through one of the protrusions;

wherein the flanking hooks each include at least one prong extending toward the opposed flanking hook.

20. A modular floor tile according to claim 19, wherein the lip of each protrusion is defined in part by a surface of the protrusion that faces opposite of the first open surface.

21. A modular floor tile according to claim 19, wherein the plurality of protrusions and the flanking hooks are sized to permit lateral sliding of the locking tab assemblies relative to the protrusions.

22. A modular floor tile according to claim 19, further comprising a plurality of support legs extending from the first open surface.

23. A modular floor tile according to claim 19, further comprising a plurality of biasing members disposed in at least one of the edge surfaces for maintaining spacing with an adjacent tile.

24. A modular floor tile according to claim 19, wherein the locking tab assemblies are disposed in at least one of the plurality of edge surfaces.

25. A modular floor tile, comprising:

a first open surface;

a plurality of edge surfaces;

a plurality of protrusions extending outwardly from at least one of the plurality of edge surfaces, at least some of the protrusions having at least one pass through opening;

a plurality of pairs of opposed flanking hooks configured to snap fit over an edge of the protrusions of an adjacent tile;

wherein the flanking hooks each include at least one barb member that projects toward the opposed flanking hook.

26. A modular floor tile according to claim 25, wherein the edge of each protrusion is defined by the intersection of a side facing surface of the protrusion and a surface of the protrusion that faces opposite the first open surface.

27. A modular floor tile according to claim 25, wherein the protrusions have a rectangular shape as viewed from above the first open surface.

28. A modular floor tile according to claim 25, wherein each pair of the opposed flanking hooks are spaced apart a distance at least as great as a width dimension of one of the protrusions.

29. A modular floor tile, comprising:

a first open surface;

a plurality of edge surfaces;

a plurality of protrusions extending outwardly from at least one of the plurality of edge surfaces, at least some of the protrusions having at least one pass through opening;

a plurality of pairs of opposed flanking hooks configured to snap fit over an edge of the protrusions of an adjacent tile, wherein the flanking hooks are spaced inward from the edge surfaces.

30. A modular floor tile according to claim 29, wherein the edge of each protrusion is defined by the intersection of a side facing surface of the protrusion and a surface of the protrusion that faces opposite the first open surface.

31. A modular floor tile according to claim 29, wherein the protrusions have a rectangular shape as viewed from above the first open surface.

32. A modular floor tile according to claim 29, wherein each pair of the opposed flanking hooks are spaced apart a distance at least as great as a width dimension of one of the protrusions.

* * * * *